US009031441B2

(12) United States Patent
Soda et al.

(10) Patent No.: US 9,031,441 B2
(45) Date of Patent: May 12, 2015

(54) IMAGE FORMING APPARATUS CAPABLE OF STABLY DETECTING TEMPERATURE OF FIXING DEVICE REGARDLESS OF ORIENTATION OF THE IMAGE FORMING APPARATUS

(71) Applicant: Konica Minolta, Inc., Chiyoda-ku (JP)

(72) Inventors: Koji Soda, Toyokawa (JP); Yasuo Nakamura, Toyokawa (JP); Masahide Wakayama, Toyokawa (JP); Yasuaki Tomoda, Toyohashi (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 147 days.

(21) Appl. No.: 13/868,553

(22) Filed: Apr. 23, 2013

(65) Prior Publication Data

US 2013/0302055 A1 Nov. 14, 2013

(30) Foreign Application Priority Data

May 11, 2012 (JP) ..... 2012-109361

(51) Int. Cl.
*G03G 15/20* (2006.01)
*G03G 21/16* (2006.01)

(52) U.S. Cl.
CPC ..... *G03G 15/2078* (2013.01); *G03G 15/2039* (2013.01); *G03G 21/1604* (2013.01); *G03G 21/1685* (2013.01)

(58) Field of Classification Search
CPC ..... G03G 15/2078; G03G 15/2039; G03G 21/1604; G03G 21/1685
USPC ..... 399/69, 107, 108, 320, 328
See application file for complete search history.

(56) References Cited

U.S. PATENT DOCUMENTS 5,512,975 A 4/1996 Kitsu et al.
5,528,344 A 6/1996 Yamaguchi et al.

(Continued)

FOREIGN PATENT DOCUMENTS

JP 7-152272 A 6/1995
JP 8-101578 A 4/1996

(Continued)

OTHER PUBLICATIONS

Office Action (Notification of Reasons for Refusal) issued on Jul. 15, 2014, by the Japanese Patent Office in corresponding Japanese Patent Application No. 2012-109361, and an English translation of the Office Action (4 pages).

(Continued)

*Primary Examiner* — William J Royer
(74) *Attorney, Agent, or Firm* — Buchanan Ingeroll & Rooney PC

(57) ABSTRACT

An image forming apparatus orientatable in either a first position or a second position, the second position being different from the first position in inclination with respect to a horizontal plane, including a fixing unit including a fixing roller and a pressurizing roller, pressing the pressurizing roller against a surface of the fixing roller to form a fixing nip, and thermally fixing a toner image on a recording sheet passing through the fixing nip; at least one temperature sensor detecting surface temperature of the fixing roller without contact with the surface; a heater heating the fixing roller; and a controller controlling the heater according to the surface temperature, thereby controlling the surface temperature, wherein a heat sensitive portion of the temperature sensor is located above a horizontal plane passing through a rotational axis of the fixing roller regardless of the orientation of the image forming apparatus.

18 Claims, 13 Drawing Sheets

(56) References Cited

U.S. PATENT DOCUMENTS

| | | | | |
|---|---|---|---|---|
| 5,697,016 | A * | 12/1997 | Kitsu et al. | 399/69 |
| 2009/0208237 | A1 | 8/2009 | Yasuda | |
| 2011/0052236 | A1 | 3/2011 | Matsuno | |
| 2012/0082474 | A1 | 4/2012 | Otsuka | |

FOREIGN PATENT DOCUMENTS

| | | | |
|---|---|---|---|
| JP | 8-314333 | A | 11/1996 |
| JP | 2006-184364 | A | 7/2006 |
| JP | 2009-180917 | A | 8/2009 |
| JP | 2011-048190 | | 3/2011 |
| JP | 2012-078563 | A | 4/2012 |

OTHER PUBLICATIONS

Decision to Grant a Patent issued in corresponding Japanese Patent Application No. 2012-109361, dated Jan. 6, 2015, and translation thereof.

* cited by examiner

200

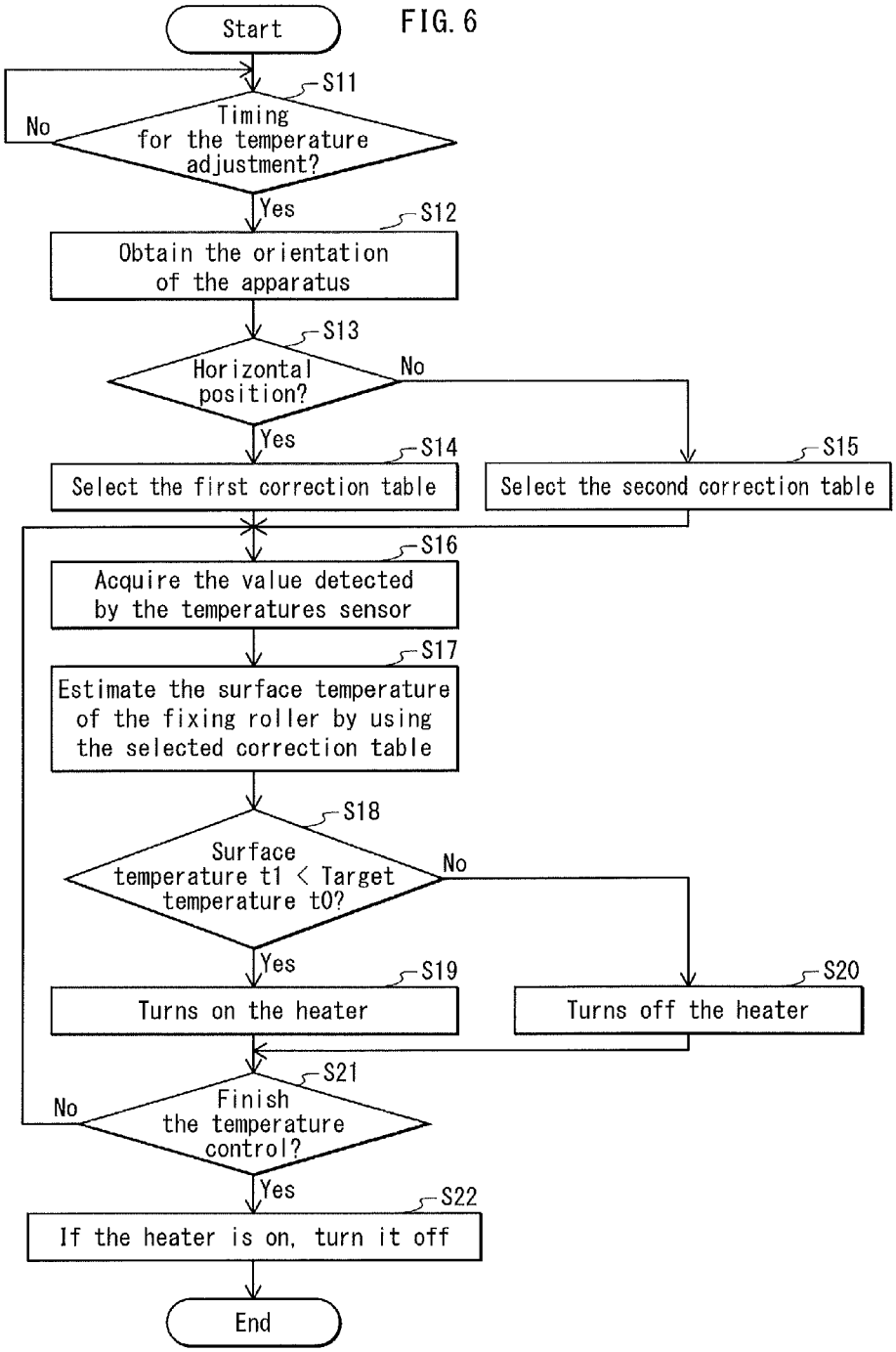
FIG. 6
Start
S11
Timing for the temperature adjustment?
No
Yes
S12
Obtain the orientation of the apparatus
S13
Horizontal position?
No
Yes
S14
Select the first correction table
S15
Select the second correction table
S16
Acquire the value detected by the temperatures sensor
S17
Estimate the surface temperature of the fixing roller by using the selected correction table
S18
Surface temperature t1 < Target temperature t0?
No
Yes
S19
Turns on the heater
S20
Turns off the heater
S21
Finish the temperature control?
No
Yes
S22
If the heater is on, turn it off
End

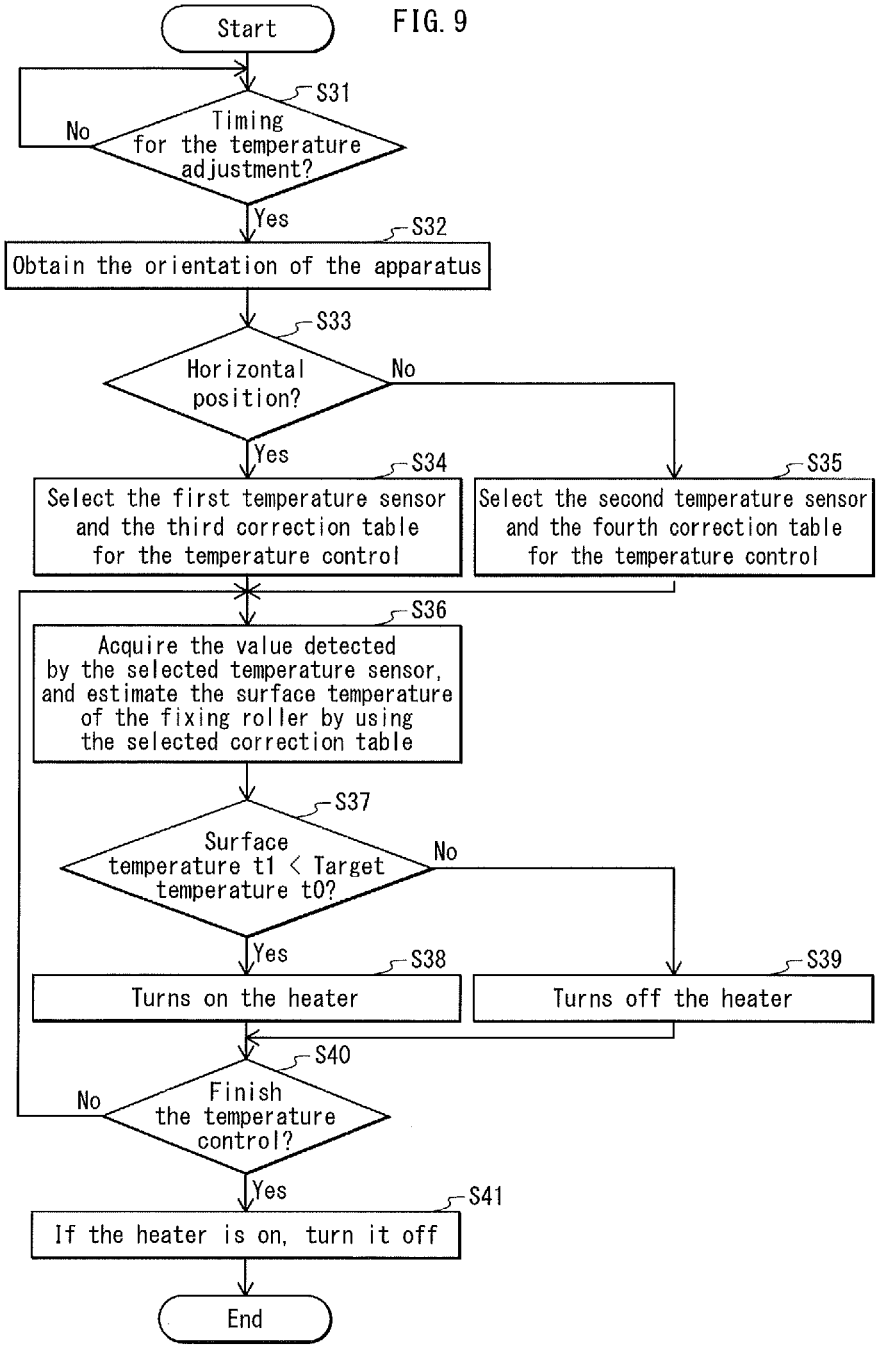
FIG. 9
Start
S31
Timing for the temperature adjustment?
No
Yes
S32
Obtain the orientation of the apparatus
S33
Horizontal position?
No
Yes
S34
Select the first temperature sensor and the third correction table for the temperature control
S35
Select the second temperature sensor and the fourth correction table for the temperature control
S36
Acquire the value detected by the selected temperature sensor, and estimate the surface temperature of the fixing roller by using the selected correction table
S37
Surface temperature t1 < Target temperature t0?
No
Yes
S38
Turns on the heater
S39
Turns off the heater
S40
Finish the temperature control?
No
Yes
S41
If the heater is on, turn it off
End

IMAGE FORMING APPARATUS CAPABLE OF STABLY DETECTING TEMPERATURE OF FIXING DEVICE REGARDLESS OF ORIENTATION OF THE IMAGE FORMING APPARATUS

This application is based on application No. 2012-109361 filed in Japan, the content of which is hereby incorporated by reference.

BACKGROUND OF THE INVENTION (1) Field of the Invention

The present invention relates to an image forming apparatus that is orientatable in different positions, and in particular to a technology of detecting the temperature inside a fixing device of the image forming apparatus.

(2) Description of Related Art

When image forming apparatuses such as printers are used, they are usually orientated in a horizontal position so that a surface of the paper feed tray, on which recording sheets are loaded, will be substantially horizontal. This is because such a position prevents the recording sheets on the paper feed tray from bending, and realizes smooth paper feeding.

However, when used in for example an ordinary house with not very large space, it is convenient if the image forming apparatus can be placed in its upright position.

Recently, considering such demand, there have been proposals of an image forming apparatus that can be used in either the horizontal position or the upright position according to the size of the installation space (e.g. Japanese Patent Application Publication No. 8-314333).

However, particularly when an electrophotographic image forming apparatus is used in the upright position, there are possibilities that temperatures of heating rollers of a fixing unit such as a fixing roller cannot be precisely controlled, for the following reasons.

Generally, the temperature of the circumferential surface of the heating roller is detected with a temperature sensor such as a thermistor located near the circumferential surface, without contact with the circumferential surface so as to avoid damaging the surface. On and off of the heating roller is controlled based on the detected temperature so that the temperature of the circumferential surface of the heating roller will be kept at a predetermined level.

However, it should be noted here that such a non-contact temperature sensor is generally configured to detect the temperature of the conductive heat due to the natural convection of the air existing between the heating roller and the temperature sensor. Therefore, when the orientation of the image forming apparatus is changed and accordingly the relative position of the temperature sensor with respect to the heating roller is changed, the convection of the air existing between the heating roller and the temperature sensor might change. Such a change causes a difference in the result of the detection by the temperature sensor.

For example, when the temperature sensor is provided vertically above the rotational center of the heating roller, the detection results will be stable and precise. In contrast, when the temperature sensor is provided beside the rotational center with respect to the horizontal direction, the detection results will vary and will not be very precise.

Therefore, even if the image forming apparatus is designed to appropriately control the temperature of the heating roller based on the results of the detection by the temperature sensor when the image forming apparatus is in the horizontal position, there is a problem that the temperature adjustment does not work properly when the image forming apparatus is in the upright position.

Such a problem can be addressed by modifying correction coefficients, which are used for converting output values from the temperature sensor to surface temperatures of the temperature sensor. In some cases, however, such modification does not suffice to solve the problem, depending on the location of the temperature sensor.

SUMMARY OF THE INVENTION

Considering the above-described problem, the present invention aims to provide an image forming apparatus that is orientatable in different positions and that is capable of precisely detecting the surface temperature of the heating roller regardless of the orientation and thereby performing appropriate temperature adjustment.

To achieve the aim, one aspect of the present invention provides an image forming apparatus that is orientatable in either a first position or a second position, the second position being different from the first position in inclination with respect to a horizontal plane, comprising: a fixing unit that includes a heating roller and a pressurizing member, presses the pressurizing member against a surface of the heating roller to form a fixing nip, and thermally fixes a toner image formed on a recording sheet passing through the fixing nip; at least one temperature detector that detects temperature of the surface of the heating roller without contact with the surface; a heater that heats the heating roller; and a controller that controls the heater according to the temperature detected by the at least one temperature detector, and thereby controls the temperature of the surface of the heating roller, wherein a detection point of the at least one temperature detector is located above a horizontal plane passing through a rotational axis of the heating roller regardless of whether the image forming apparatus is in the first position or in the second position.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings:

FIG. 6 is a flowchart showing processing procedures for temperature adjustment performed by a controller pertaining to Embodiment 2 of the present invention;

FIG. 9 is a flowchart showing processing procedures for temperature adjustment performed by a controller of the image forming apparatus pertaining to Embodiment 3 of the present invention;

DESCRIPTION OF PREFERRED EMBODIMENTS

Embodiment 1

The following describes an image forming apparatus pertaining to Embodiment 1 of the present invention, with reference to the drawings.

(1-1) Structure of Image Forming Apparatus

Figure 1:
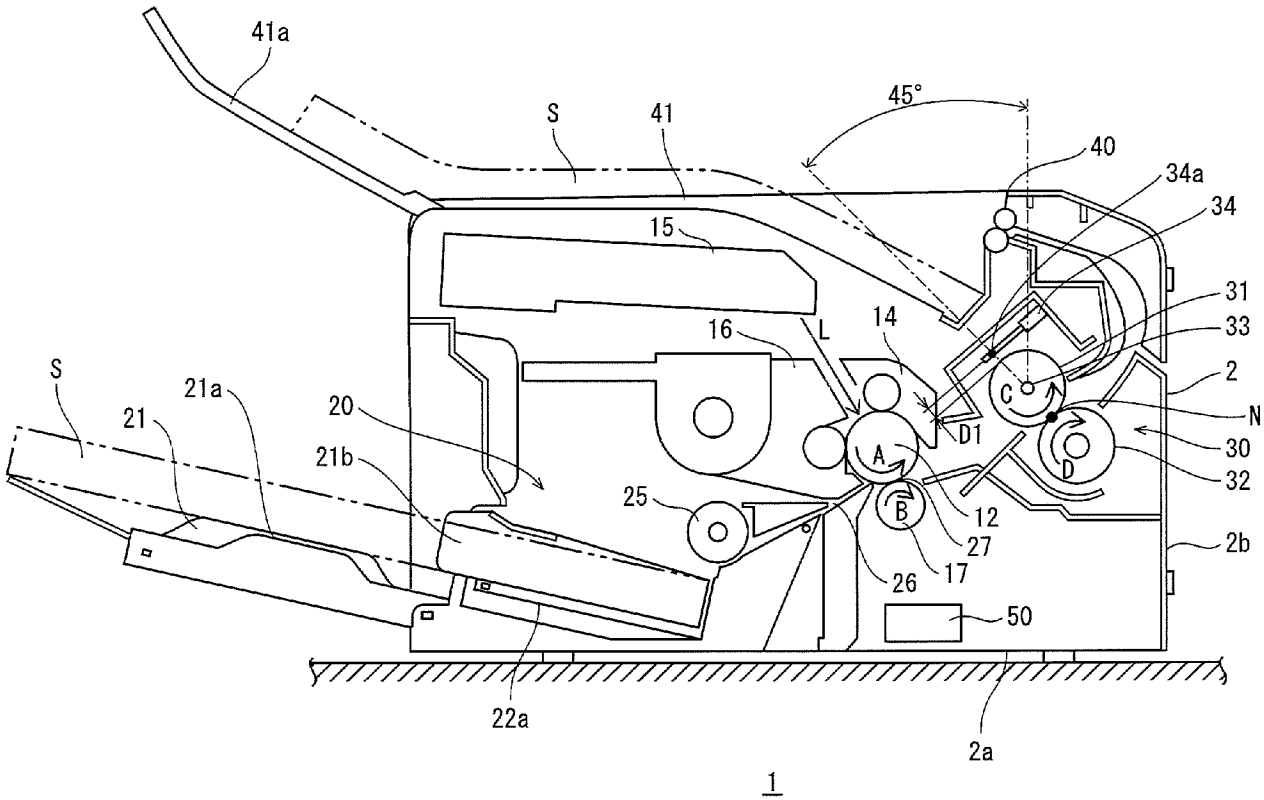
FIG. 1 is a schematic cross-sectional view of an image forming apparatus pertaining to Embodiment 1 of the present invention, orientated in the horizontal position.

FIG. 1 a schematic cross-sectional view for explaining the structure of a monochrome printer as an example of an image forming apparatus pertaining to Embodiment 1 of the present invention.

A printer 1 has a casing 2 having an almost rectangular parallelepiped shape. The printer 1 is orientatable in either "a horizontal position" in which a largest face 2*a* of the casing 2 is in contact with an installation surface and a paper feed tray 21 is positioned almost horizontally, or "an upright position" in which a face 2*b* of the casing 2, which is smaller than and perpendicular to the face 2*a*, is in contact with the installation surface. FIG. 1 shows the printer 1 in the horizontal position.

The user usually installs the printer 1 in the horizontal position, and selects the upright position when the space for placing the printer 1 is limited.

The printer 1 has a cylindrical photosensitive drum 12 which is rotatable in the direction indicated by the arrow A.

Around the photosensitive drum 12, a charger 14, an optical unit 15, a developer 16 and a transfer roller 17, which are used for forming a toner image on a recording sheet S by an electrophotographic method, are provided in the stated order along the rotation direction of the photosensitive drum 12 (i.e. in the counterclockwise direction shown in the drawing).

In the printer 1, a controller 50 converts image data received from an external device to a drive signal suitable for a laser diode, and drives the laser diode of the optical unit 15 by using the drive signal.

Thus, the optical unit 15 irradiates the surface of the photosensitive drum 12 with a laser beam L corresponding to the image data.

The surface of the photosensitive drum 12 is charged in advance at a predetermined potential by the charger 14. When the surface of the photosensitive drum 12 is irradiated with the laser beam L from the optical unit 15, an electrostatic latent image is formed on the surface of the photosensitive drum 12. The electrostatic latent image is developed by the developer 16 using toner, and thus a toner image is formed.

A paper feeder 20 is provided below the photosensitive drum 12. The paper feeder 20 includes the paper feed tray 21, a pickup roller 25, and the like. The paper feed tray 21 houses a stack of recording sheets S, such as sheets of paper or OHP sheets.

The pickup roller 25 picks up the uppermost sheet one by one from among the recording sheets S in the paper feed tray 21, and conveys the sheet onto a transport path 26 running toward the photosensitive drum 12.

A lift-up plate 22*a* of the paper feed tray 21 is moved upward or downward by a driving mechanism such as a cam mechanism (not illustrated). The lift-up plate 22*a* is moved upward when the recording sheets S are transported onto the transport path 26, so that the uppermost recording sheet S is pressed against the pickup roller 25.

The transfer roller 17, which is rotated in the direction indicated by the arrow B, is disposed to be pressed against the circumferential surface of the photosensitive drum 12, and thus a transfer nip 27 is formed. The recording sheet S is transported to the transfer nip 27 through the transport path 26.

While the recording sheet S is passing through the transfer nip 27, the toner image carried on the photosensitive drum 12 is transferred to the recording sheet S due to an electric field generated by a transfer voltage applied to the transfer roller 17.

After the toner image is transferred onto the recording sheet S, the surface of the photosensitive drum 12 is cleaned up by a cleaning blade or the like (not illustrated).

Meanwhile, the recording sheet S on which the toner image has been transferred is transported to a fixing unit 30, sometimes referred to as the fixing device.

The fixing unit 30 includes a fixing roller 31, sometimes referred to as a heating roller, and a pressure roller 32, sometimes referred to as a pressurizing member, disposed in parallel, and a fixing nip N is formed between the fixing roller 31 and the pressure roller 32.

The fixing roller 31 is rotated in the direction indicated by the arrow C by a drive source (not illustrated), and has a built-in heater (halogen lamp) 33. With this structure, the surface of the fixing roller 31 is heated so that its temperature at a point immediately before the fixing nip N (hereinafter simply "the surface temperature") will be a targeted temperature.

When the fixing roller 31 is rotated, the pressure roller 32 is rotated together with the fixing roller 31 in the direction indicated by the arrow D.

Alternatively, the fixing roller 31 may be rotated together with the pressure roller 32 when the pressure roller 32 is rotated.

The fixing unit 30 is provided with a temperature sensor 34, sometimes referred to as a temperature detector, for detecting the surface temperature of the fixing roller 31. The temperature sensor 34 is located in the middle area of the fixing roller 31 in the longitudinal direction (i.e. the depth direction of the sheet of the drawing).

The temperature sensor 34 is made up from a relatively cheap thermal sensor such as a thermistor or a thermocouple, and is located at a distance from the surface of the fixing roller 31 so as to avoid damaging the surface. Thus, the temperature sensor 34 detects the surface temperature of the fixing roller 31 by detecting the temperature of the conductive heat from the air.

In Embodiment 1, an NTC thermistor is used as an example of the temperature sensor 34.

While the recording sheet S is passing through the fixing nip N, the fixing roller 31 applies predetermined amounts of heat and pressure to the unfixed toner image transferred on the recording sheet S, so that the image is fixed onto the recording sheet S.

After passing through the fixing nip N, the recording sheet S is transported to an ejection roller 40 by the fixing roller 31 and the pressure roller 32, and is ejected onto an output tray 41 by the ejection roller 40.

Note that a detachable extension tray 41*a* is provided downstream of the output tray 41. The extension tray 41*a* prevents the recording sheet S from hanging down when the recording sheet S is large in size.

The controller 50 totally controls the components of the printer 1, and thereby realizes smooth execution of print jobs. As part of such control, the controller 50 monitors the surface temperature of the fixing roller 31 by using the temperature sensor 34, and controls ON and OFF of the heater 33 to adjust the surface temperature to be at a target level.

Figure 2:
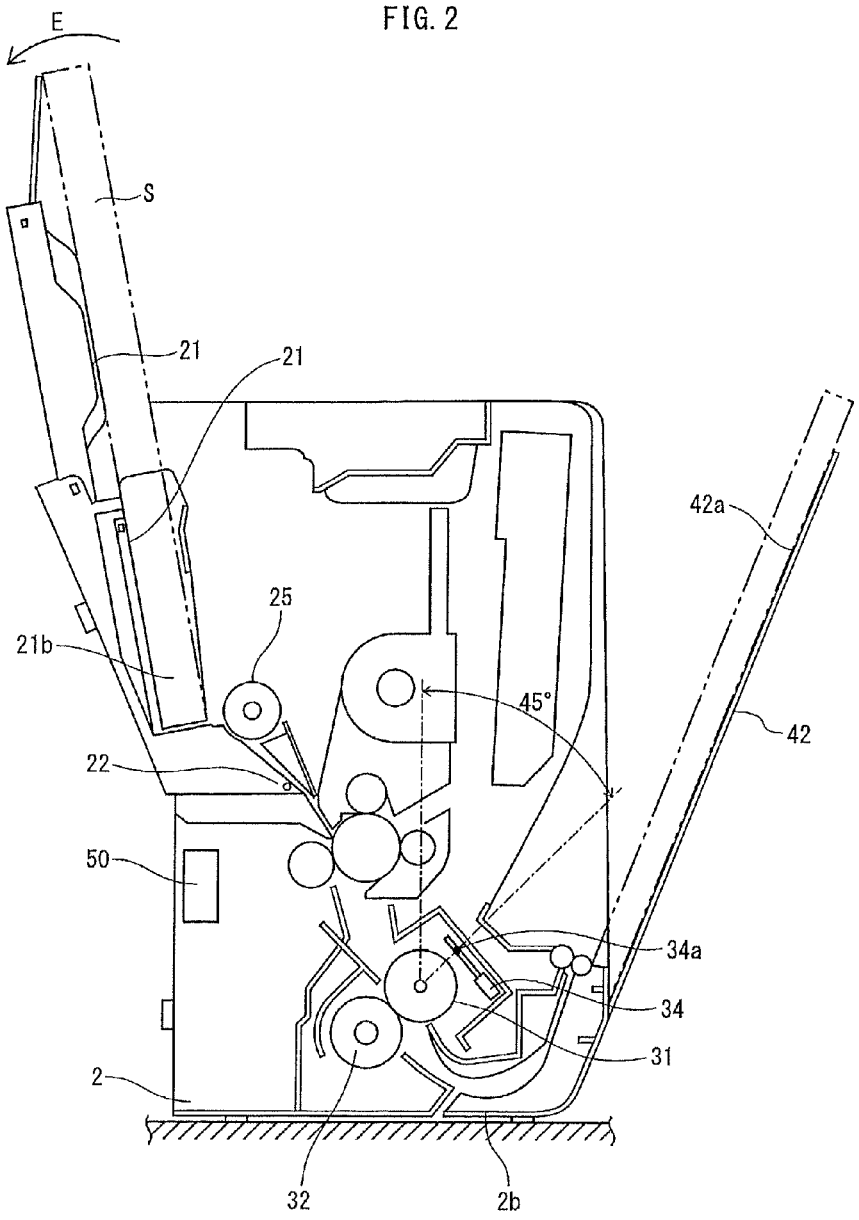
FIG. 2 is a schematic cross-sectional view of the image forming apparatus orientated in the upright position.

FIG. 2 is a schematic cross-sectional view of the printer 1 orientated in the upright position, in which the face 2*b* of the casing 2 is in contact with the installation surface.

When orientating the printer 1 in the upright position, the user moves the paper feed tray 21 to swing in the direction indicated by the arrow E about a shaft 22.

Consequently, a surface 21*a* of the paper feed tray 21, on which the recording sheets S are to be loaded, slightly inclines with respect to the vertical direction so that the recording sheets S can be mounted so as to lean against the paper feed tray 21.

The paper feed tray 21 is provided also with a pair of guide plates 21*b* at both ends of the paper feed tray 21 in the widthwise direction (i.e. the depth direction of the sheet of the drawing). The pair of guide plates 21*b* guide the edges in the widthwise direction of the recording sheets S, and simultaneously, prevent the recording sheets S from falling from the paper feed tray 21 by filling the gap formed between the casing 2 and the paper feed tray 21 when the printer 1 is orientated in the upright position.

Here, the pickup roller 25 and the drive source (not illustrated) connected to the pickup roller 25 are configured to swing together with the paper feed tray 21. Therefore, the pickup roller 25 can be brought into contact with the uppermost sheet of the recording sheets S regardless of the orientation of the printer 1.

When orientating the printer 1 in the upright position, the user detaches the extension tray 41*a* (c.f. FIG. 1) from the casing 2, and attaches another extension tray 42 instead.

Thus, a surface 42*a*, which slightly inclines with respect to the vertical direction, is formed. Therefore, the ejected recording sheets S can be stacked on the surface 42*a*. If the extension tray 41*a* is designed to be usable when the printer 1 is in the upright position as well, it is unnecessary to provide the extension tray 42, and the cost of the extension tray 42 can be reduced.

The temperature sensor 34 of Embodiment 1 has a portion 34*a* with a high thermal-detection sensitivity (hereinafter referred to as the "heat sensitive portion 34*a*").

Here, assume the case of changing the orientation of the printer 1 from the horizontal position to the upright position by rotating the printer 1 clockwise. As shown in FIG. 1, when the printer 1 is in the horizontal position, the heat sensitive portion 34*a* of the temperature sensor 34 is located at a point on the line tilted counterclockwise by 45° from the vertical line passing through the rotational center of the fixing roller 31.

The minimum distance D1 between the surface of the fixing roller 31 and the heat sensitive portion 34*a* (see FIG. 1) is set to be 2.3 mm±0.3 mm.

Such a value of D1 is determined so that the heat sensitive portion 34*a* can precisely detect the surface temperature of the fixing roller 31 while avoiding damaging the surface of the fixing roller 31 by contacting with the surface due to a positional error that could occur in assembly of the printer 1.

Here, when the orientation of the printer 1 is changed from the horizontal position to the upright position by rotating the printer 1, the rotational angle will be 90°, since the face 2*a* and the face 2*b* are perpendicular to each other.

As a result, when seen in the direction along the axis of the fixing roller 31 as shown in FIG. 1, the heat sensitive portion 34*a* initially located at a point on the line tilted counterclockwise by 45° from the vertical line passing through the rotational center of the fixing roller 31 (hereinafter simply "the vertical line") when the printer 1 is in the horizontal position will be moved to a point on the line tilted clockwise by 45° from the vertical line when the printer 1 is in the upright position as shown in FIG. 2. Thus, the location of the heat sensitive portion 34*a* in the case of the horizontal position and the location of the heat sensitive portion 34*a* in the case of the upright position are diametrically opposite each other with respect to the vertical line.

Since the natural convection of the air due to the temperature rise of the fixing roller 31 can be considered as being symmetric with respect to the vertical line, the amount of heat conducted from the surface of the fixing roller 31 to the heat sensitive portion 34*a* can be considered as being substantially the same regardless of whether the printer 1 is in the horizontal position or in the upright position.

(1-2) Structure of Controller

Figure 3:
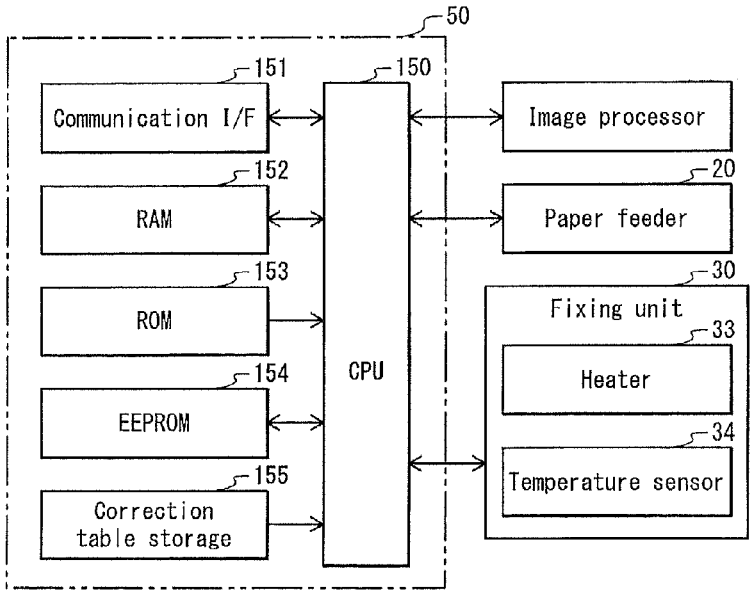
FIG. 3 is a block diagram showing a controller of the image forming apparatus and components under the control of the controller.

FIG. 3 shows the structure of the controller 50 of the printer 1 and the relationship with primary components under the control of the controller 50.

The controller 50 includes, as primary components, a CPU 150, a communication interface (I/F) 151, a RAM 152, a ROM 153, an EEPROM 154 and a correction table storage 155.

The communication I/F 151 is an interface for connecting to a LAN, such as a LAN card and a LAN board.

The RAM (Random Access Memory) 152 is a volatile memory, and serves as a work area when the CPU 150 executes a program.

The ROM (Read Only Memory) 153 stores, for example, a control program used for performing control related to the execution of printing.

The EEPROM (Electronically Erasable and Programmable Read Only Memory) 154 is non-volatile memory, and serves as a data area used by the CPU 150.

The correction table storage 155 is made up from an EEPROM, and stores a correction table used for the temperature adjustment which will be discussed later.

The CPU (Central Processing Unit) 150 performs warming-up or printing by executing a control program stored in the ROM 153.

The CPU 150 turns ON or OFF the heater 33 provided in the fixing roller 31 according to the signals output from an orientation detector 51 (FIG. 4), the first temperature sensor 34, and a second temperature sensor of the fixing unit 30, and thereby performs the following temperature adjustment for adjusting the temperature of the fixing roller 31 to be at a target level.

(1-3) Temperature Adjustment

The following describes the procedures performed by the controller 50 pertaining to Embodiment 1 to control the temperature of the fixing roller 31.

At warming-up or printing, the CPU (Central Processing Unit) 150 obtains the surface temperature of the fixing roller 31 by using the detection result of the temperature sensor 34, and controls the temperature of the fixing roller 31.

Here, the surface temperature of the fixing roller 31 is obtained by using the detection result of the temperature sensor 34 and a correction table, for the following reason.

The temperature sensor 34 is a non-contact sensor as described above, and hence its detection value is not exactly the same as the actual surface temperature of the fixing roller 31. That is, the temperature sensor 34 actually detects the temperature of the air conveyed to the heat sensitive portion 34*a* due to the natural convection.

Considering this, the actual surface temperature of the fixing roller 31 and the detection value of the temperature sensor 34 are obtained in advance by experiment under the condition that the printer 1 is in the horizontal position, and a correction coefficient is calculated for each detection value obtained by the temperature sensor 34. Here, the correction coefficient is used for converting the detection values to the actual surface temperatures of the fixing roller 31. Thus, a correction table associating the detection values of the temperature sensor 34 with the correction coefficients is created, and the correction table storage 155 stores such a table.

In the natural convection, the air flows upward. Therefore, when the heat sensitive portion 34*a* of the temperature sensor 34 is displaced from the point right above the fixing roller 31 along the circumferential direction of the fixing roller 31, the heat sensitive portion 34*a* goes out of the main stream of the convection, and the air around the heat sensitive portion 34*a* does not flow smoothly.

As a result, the detection value of the temperature sensor 34 does not precisely reflect the surface temperature of the fixing roller 31 as greatly affected by the atmospheric temperature.

When seen in the direction of the rotational shaft of the fixing roller 31, the relationship between the actual surface temperature of the fixing roller 31 and the detection value of the temperature sensor 34 will be weak as the positional angle of the heat sensitive portion 34*a* increases (Here, the term "positional angle" means the angle formed by the line passing through the rotational center of the fixing roller 31 and the point on which the heat sensitive portion 34*a* is located and the vertical line passing through the rotational center of the fixing roller 31).

As a result, there is a possibility that the detection result of the temperature sensor 34 does not change very much even when the surface temperature of the fixing roller 31 changes, or the detection result of the temperature sensor 34 greatly changes due to the influence of the atmospheric temperature even when the surface temperature does not change. In such cases, it is difficult to make the correction by using only the correction table.

When controlling the temperature of the fixing roller 31 to keep the fixing performance stable, it is preferable that the acceptable range of the error in the detection of the surface temperature is within the range of ±5%.

Considering the above, the inventors conducted a test to examine the relationship between the actual surface temperature of the fixing roller 31 and the detection value of the temperature sensor 34 by changing the positional angle mentioned above while keeping the minimum distance D1 between the heat sensitive portion 34*a* and the surface of the fixing roller 31. As a result, the inventors found out the acceptable range of the position of the heat sensitive portion 34*a* at which the surface temperature can be estimated with the correction table.

According to the results of the test, the detection value of the temperature sensor 34 does not correctly reflect the surface temperature of the fixing roller 31 when the heat sensitive portion 34*a* is located in or below the horizontal plane passing through the rotational center of the fixing roller 31. In such cases, the inventors found out that it was difficult to create a correction table that can correct the detection error to fall within the acceptable range of the error described above.

Therefore, in order to precisely detect the surface temperature of the fixing roller 31, it is necessary that the heat sensitive portion 34*a* is located above the horizontal plane passing through the rotational center of the fixing roller 31 regardless of whether the printer 1 is in the horizontal position or in the upright position.

In this regard, the location of the heat sensitive portion 34*a* in Embodiment 1, namely the location on the line tilted counterclockwise by 45° from the vertical line passing through the rotational center of the fixing roller 31, satisfies the above-mentioned condition as to the acceptable range of the detection error, required for keeping the fixing quality.

Also, in the present embodiment, the location of the heat sensitive portion 34*a* in the case of the horizontal position and the location of the heat sensitive portion 34*a* in the case of the upright position are diametrically opposite each other with respect to the vertical plane passing through the rotational center of the fixing roller 31.

Hence, the state of the heat conduction, including the state of the convection of the air, is substantially the same the heat sensitive portion 34*a* regardless of the orientation of printer 1. Therefore, the surface temperature of the fixing roller 31 can be precisely estimated with the same correction table regardless of the orientation of the printer 1.

Since the same correction table is used regardless of the orientation of the printer 1, the required size of the correction table storage 155 for storing the correction table can be reduced.

Embodiment 2

(2-1) Structure of Image Forming Apparatus

The following describes a printer as an example of an image forming apparatus pertaining to Embodiment 2 of the present invention, with reference to the drawings.

The structure of a printer 200 pertaining to Embodiment 2 is basically similar to the printer 1 pertaining to Embodiment 1 described above, but the printer 200 pertaining to Embodiment 2 is different from the printer 1 in that the printer 200 is further provided with an orientation detector 51 which outputs a detection value to the controller 50, in that the location of the temperature sensor 34 is changed, and that two correction tables are used.

In the following, the same components as Embodiment 1 are given the same reference numbers and their descriptions are omitted or simplified, and mainly the differences will be described.

Figure 4:
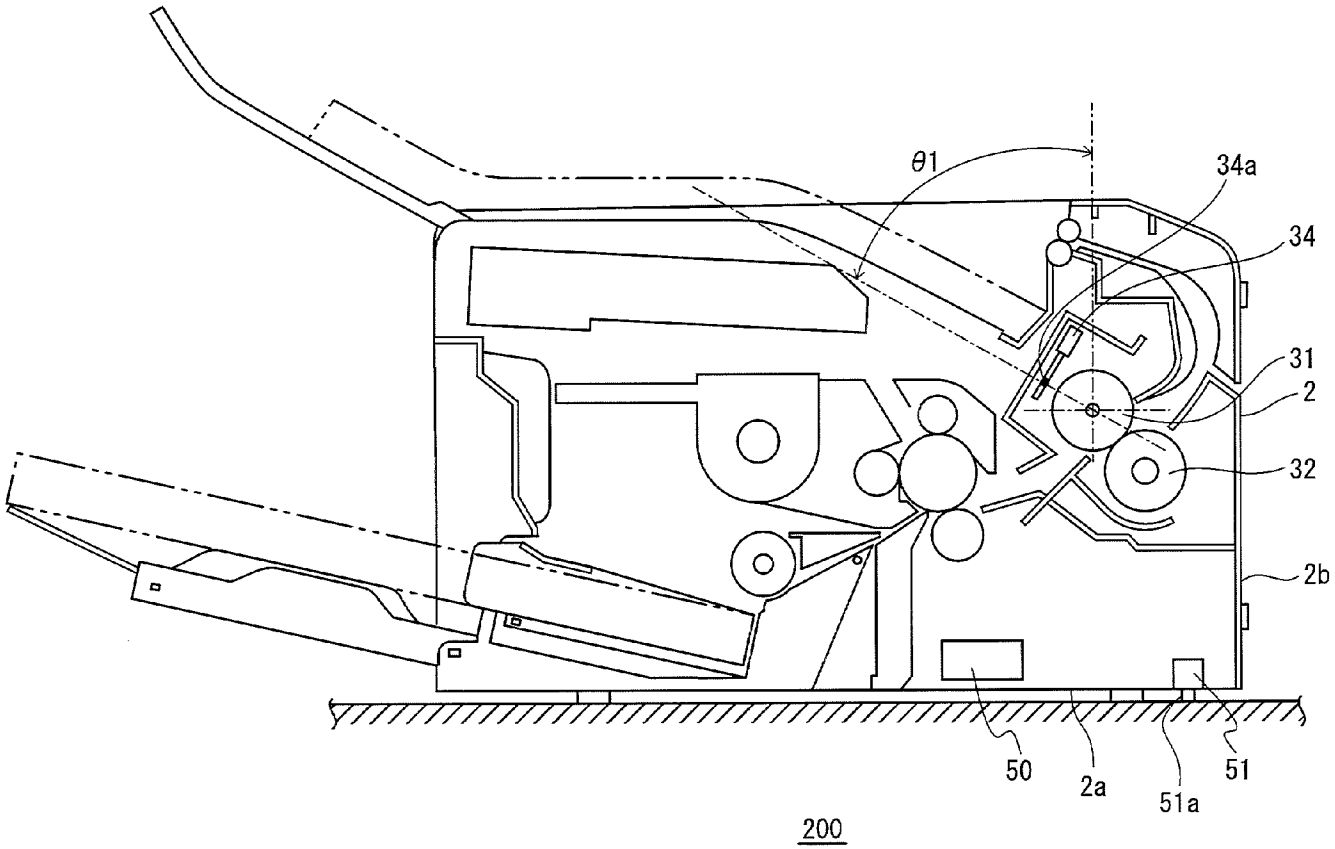
FIG. 4 is a schematic cross-sectional view of an image forming apparatus pertaining to Embodiment 2 of the present invention, orientated in the horizontal position.

FIG. 4 is a schematic cross-sectional view of the printer 200 pertaining to Embodiment 2 orientated in the horizontal position.

As shown in the drawing, the printer 200 is provided with an orientation detector 51 that detects the orientation of the printer 200.

The orientation detector 51 is a push switch having an actuator 51*a* which protrudes outward from the face 2*a* of the casing 2. When the printer 200 is orientated in the horizontal position, the actuator 51*a* is pressed by the installation surface. Detecting such a movement of the actuator 51*a*, the orientation detector 51 outputs to the controller 50 a signal indicating that the printer 200 is in the horizontal position.

As shown in FIG. 4, when the printer 200 is in the horizontal position, the heat sensitive portion 34*a* of the temperature sensor 34 of the fixing unit is located at the point on the line that is tilted counterclockwise by an angle θ1 (degrees) from the vertical line passing through the widthwise midpoint of the fixing roller 31. When the printer 200 is in the upright position (FIG. 5), the heat sensitive portion 34*a* of the temperature sensor 34 is located at the point on the line that is tilted clockwise by an angle θ2 (degrees) from the vertical line passing through the widthwise midpoint of the fixing roller 31.

Note that when changing the orientation of the printer 200 from the horizontal position to the upright position by rotating the printer 200, the rotational angle is 90°, and therefore θ1 and θ2 satisfy θ1+θ2=90.

As described above, in order to precisely detect the surface temperature of the fixing roller 31, it is necessary that the heat sensitive portion 34*a* is located above the horizontal plane passing through the rotational center of the fixing roller 31 regardless of whether the printer 200 is in the horizontal position or in the upright position.

To satisfy this condition, both θ1 and θ2 are greater than 0 and smaller than 90.

In Embodiment 2, it is assume that θ1 is greater than θ2.

The structure of the controller 50 is basically similar to the printer 1 pertaining to Embodiment 1 described above. However, it is different from Embodiment 1 in that the correction table storage 155 stores two correction tables, namely a first correction table and a second correction table, because the location of the heat sensitive portion 34*a* with respect to the vertical line passing through the rotational center of the fixing roller 31 is different according to whether the printer 200 is in the horizontal position or in the upright position.

(2-2) Temperature Adjustment

The following describes the procedures performed by the controller 50 included in Embodiment 2 to control the temperature of the fixing roller 31, with reference to the flowchart shown in FIG. 6.

The CPU 150 waits until the timing for adjusting the temperature of the fixing roller 31 (Step S11: NO). The CPU 150 determines to start the temperature adjustment, for example immediately after the printer 200 is powered on or when receiving a print job (Step S11: YES), and obtains an output signal from the orientation detector 51 (FIG. 4) as information indicating the current orientation of the printer 200 (Step S12).

When determining that the printer 200 is in the horizontal position based on the information (Step S13: YES), the CPU selects the first correction table as the correction table used for temperature conversion (Step S14), and obtains the value detected by the temperature sensor (Step S16).

When determining that the printer 200 is in the upright position based on the information (Step S13: NO), the CPU selects the second correction table as the correction table used for temperature conversion (Step S15), and obtains the value detected by the temperature sensor (Step S16)

Then, the CPU 150 estimates the surface temperature of the fixing roller 31 by using the correction table thus selected and the detection value of the temperature sensor (Step S17).

The following describes the first correction table and the second correction table.

The first correction table is used for converting the detection value of the temperature sensor 34 to the surface temperature of the fixing roller 31 when the printer 200 is in the horizontal position. The second correction table is used for converting the detection value of the temperature sensor 34 to the surface temperature of the fixing roller 31 when the printer 200 is in the upright position. Both correction tables are optimized as described below.

Figure 5:
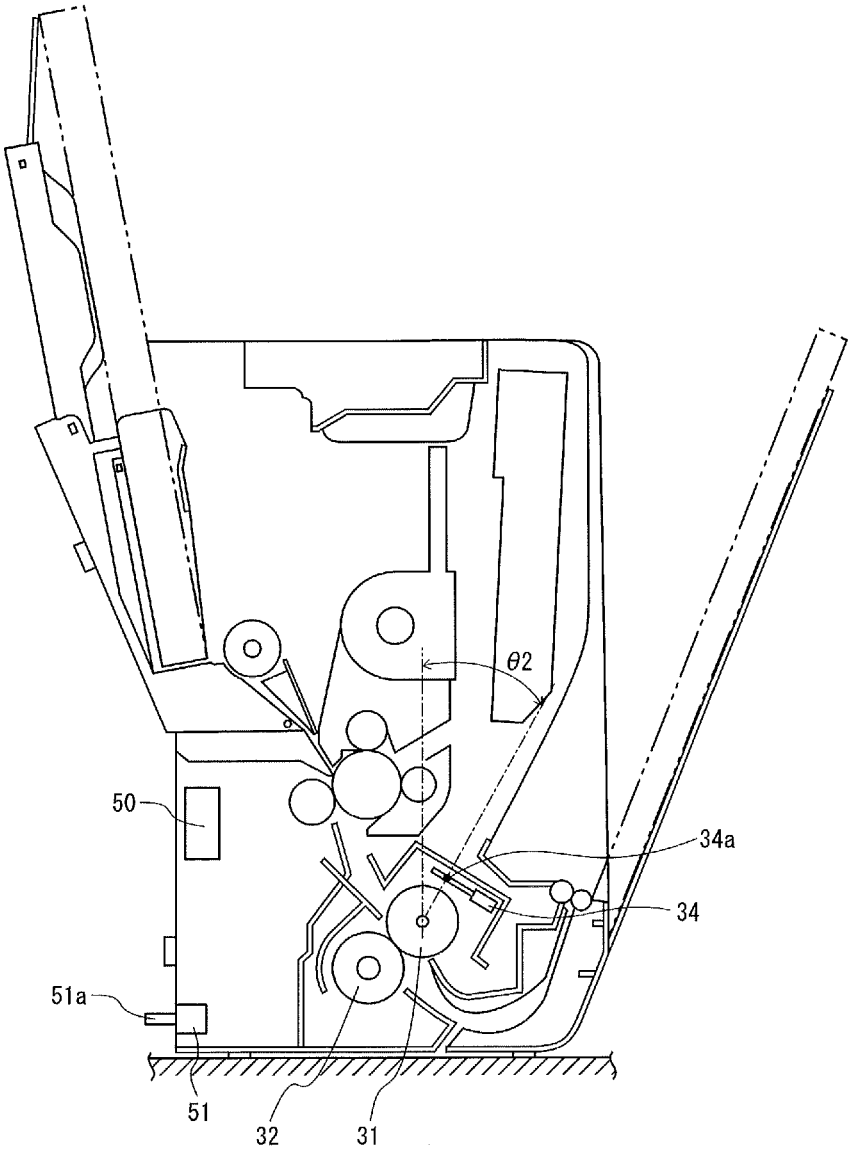
FIG. 5 is a schematic cross-sectional view of the image forming apparatus pertaining to Embodiment 2 of the present invention, orientated in the upright position.

As shown in FIG. 4 and FIG. 5, the area occupied by the fixing roller 31 within the upstream space of the air convection to the heat sensitive portion 34*a* (i.e. the space below the heat sensitive portion 34*a*) is larger when the printer 200 is in the upright position than when the printer 200 is in the horizontal position. Hence, when the printer 200 is in the upright position, the temperature sensor 34 obtains a more precise value reflecting the surface temperature of the fixing roller 31.

In contrast, when the printer 200 is in the horizontal position, the detection result of the temperature sensor 34 is more likely to have an influence of the atmospheric temperature, relative to when the printer 200 is in the upright position.

Considering such a difference in the condition of the air convection according to the orientation of the printer 200, the correction coefficients in the first and second correction tables are modified so that the range of the error in the temperature detection falls within the acceptable range (±5%) with which the temperature adjustment for the fixing roller 31 works properly.

When the surface temperature t1 of the fixing roller 31, obtained by using the correction table described above, is lower than the target temperature t0 (Step S18: YES), the CPU 150 turns ON the heater 33 (Step S19) to apply heat to the fixing roller 31. When the surface temperature t1 is equal to or higher than the target temperature t0 (Step S18: NO), the CPU 150 turns OFF the heater 33 (Step S20).

Then, the CPU 150 determines whether to finish the temperature adjustment (Step S21). The CPU 150 determines to finish the temperature adjustment, for example immediately after a print job is completed, or after a predetermined interval from the completion of a print job.

When determining not to finish the temperature adjustment (Step S21: NO), the CPU 150 repeats the above-described Steps S16 through S21.

When determining to finish the temperature adjustment (Step S21: YES), the CPU 150 checks the power state of the heater 33 at the time of the determination. When the heater 33 is ON, the CPU 150 turns OFF the heater 33 (Step S22), and then finishes the temperature adjustment.

Thus, with Embodiment 2 described above, even when the location of the heat sensitive portion 34*a* with respect to the vertical line passing through the rotational center of the fixing roller 31 is changed according to the orientation of the printer 200, a precise value indicating the surface temperature of the fixing roller 31 can be obtained by selectively using either the first correction table or the second correction table.

Embodiment 3

(3-1) Structure of Image Forming Apparatus

The following describes a printer as an example of an image forming apparatus pertaining to Embodiment 3 of the present invention, with reference to the drawings.

The structure of a printer 300 pertaining to Embodiment 3 is basically similar to the printer 200 pertaining to Embodiment 2 described above, but the printer 300 pertaining to Embodiment 3 is different from the printer 200 in that the printer 300 is provided with two temperature sensors used for adjusting the temperature of the fixing roller 31 and each outputs a detection value to the controller 50, and in that the control performed by the controller 50 is slightly modified from Embodiment 2.

Furthermore, Embodiment 3 is different from Embodiment 2 in that the correction table storage 155 stores a third correction table and a fourth correction table. The details of the third correction table and the fourth correction table will be described later.

In the following, the same components as Embodiment 2 are given the same reference numbers and their descriptions are omitted or simplified, and mainly the differences will be described.

Figure 7:
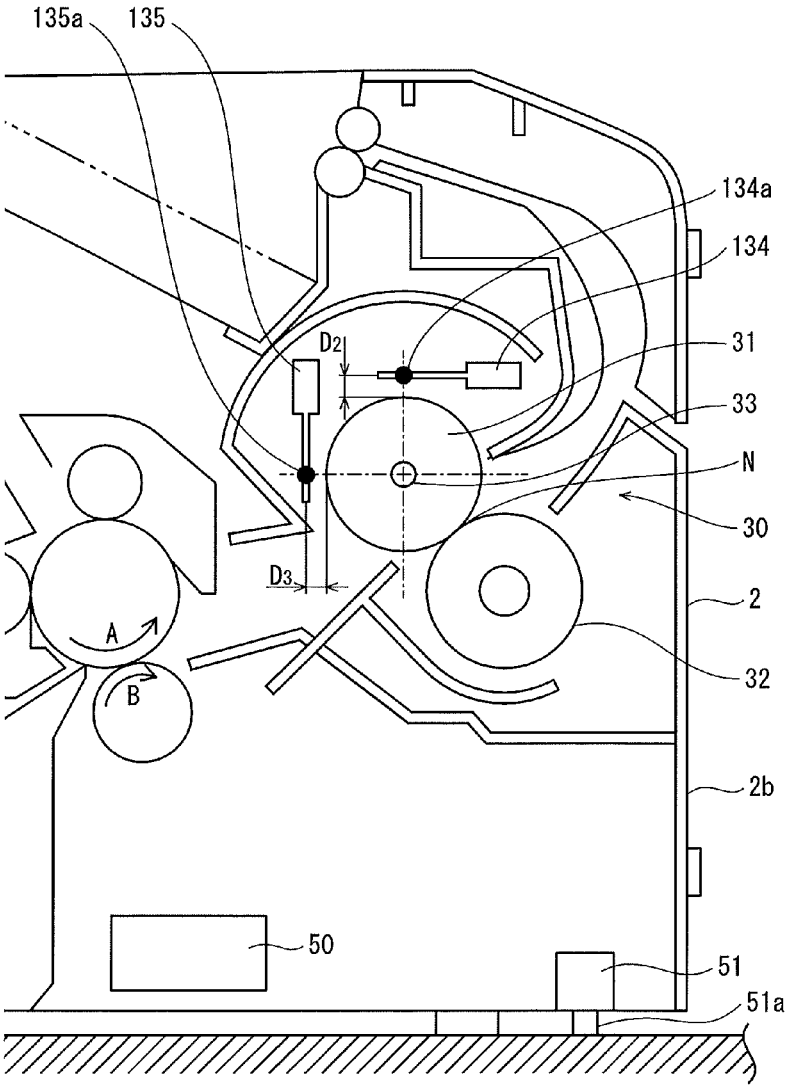
FIG. 7 is a schematic cross-sectional view of an image forming apparatus pertaining to Embodiment 3 of the present invention, orientated in the horizontal position.
Figure 8:
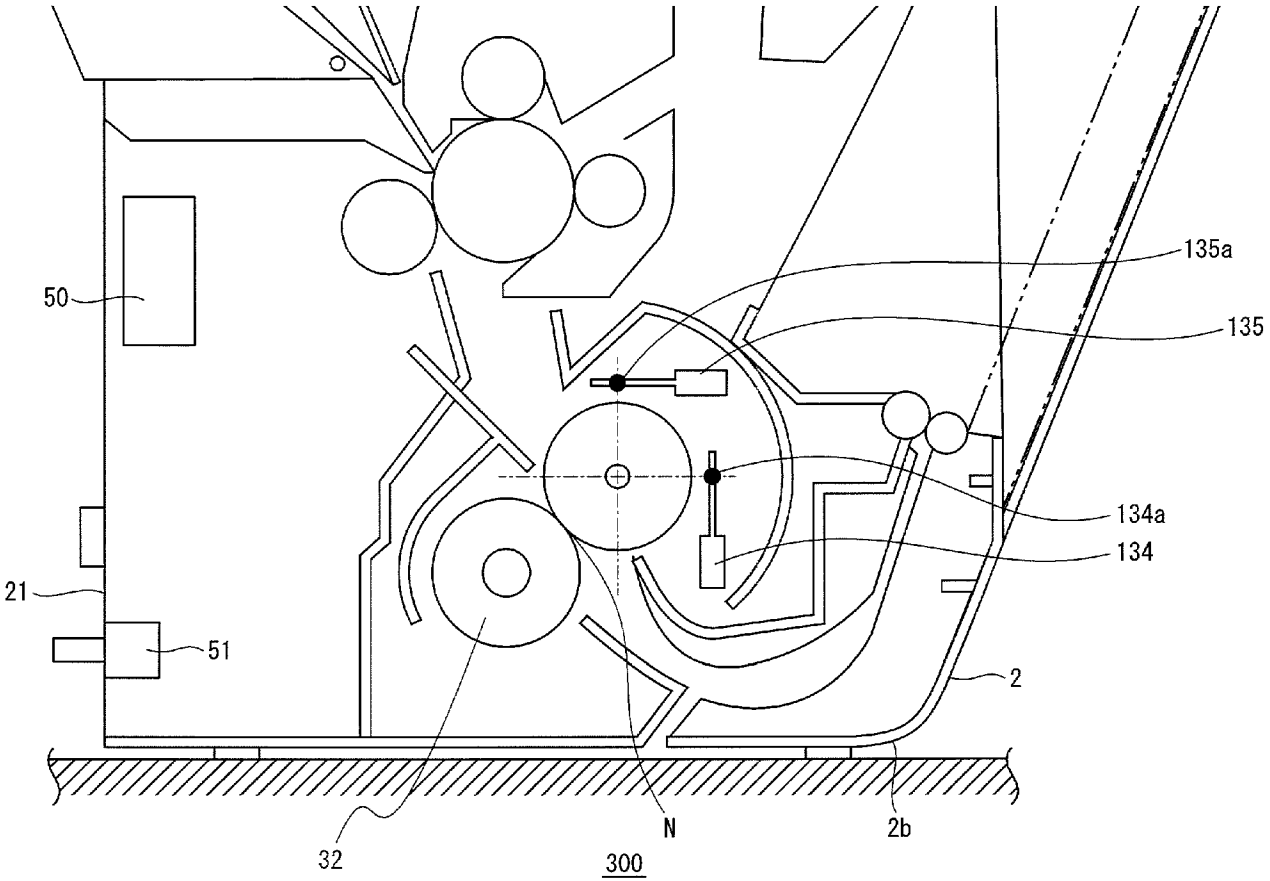
FIG. 8 is a schematic cross-sectional view of the image forming apparatus pertaining to Embodiment 3 of the present invention, orientated in the upright position.

FIG. 7 is a schematic cross-sectional view of the printer 300 pertaining to Embodiment 3 orientated in the horizontal position, and FIG. 8 is a schematic cross-sectional view of the printer 300 pertaining to Embodiment 3 orientated in the upright position.

As shown in FIG. 7, the fixing unit 30 of the printer 300 is provided with a first temperature sensor 134 and a second temperature sensor 135 for detecting the surface temperature of the fixing roller 31.

The first temperature sensor 134 and the second temperature sensor 135 have the same structure as the temperature sensor 34 of Embodiment 1, and have the heat sensitive portion 134*a* and the heat sensitive portion 135*a*, respectively.

When the printer 300 is in the horizontal position, the heat sensitive portion 134*a* is located above the widthwise midpoint of the fixing roller 31 on the vertical line passing through the axial center of the fixing roller 31 as shown in FIG. 7 (Such a position is hereinafter simply referred to as the position "right above the midpoint of the roller").

When the printer 300 is in the upright position, the heat sensitive portion 135*a* is located right above the midpoint of the roller as shown in FIG. 8.

For the same reasons as for the temperature sensor 34 of Embodiment 1, the minimum distance D2 between the heat sensitive portion 134*a* and the surface of the fixing roller 31 and the minimum distance D3 between the heat sensitive portion 135*a* and the surface of the fixing roller 31 are both set to be 2.3 mm±0.3 mm (See FIG. 7).

(3-2) Temperature Adjustment

The following describes the procedures performed by the controller 50 included in Embodiment 3 to control the temperature of the fixing roller 31, with reference to the flowchart shown in FIG. 9.

First, the CPU 150 waits until the timing for adjusting the temperature of the fixing roller 31 (Step S31: NO). The CPU 150 determines to start the temperature adjustment, for example immediately after the printer 300 is powered on or when receiving a print job (Step S31: YES), and obtains an output signal from the orientation detector 51 as information indicating the current orientation of the printer 300 (Step S32).

When determining that the printer 300 is in the horizontal position based on the information (Step S33: YES), the CPU selects the first temperature sensor 134 as the temperature sensor used for the temperature adjustment, and selects the third correction table as the correction table used for the temperature adjustment (Step S34).

Then, the CPU 150 estimates the surface temperature of the fixing roller 31 by using the detection value output from the first temperature sensor 134 and the third correction table thus selected (Step S36).

When determining that the printer 300 is in the upright position based on the information (Step S33: NO), the CPU selects the second temperature sensor 135 as the temperature sensor used for the temperature adjustment, and selects the fourth correction table as the correction table used for the temperature adjustment (Step S35). Then, the CPU 150 estimates the surface temperature of the fixing roller 31 by using the detection value output from the second temperature sensor 135 and the fourth correction table thus selected (Step S36).

Since the heat sensitive portion of the selected temperature sensor is located right above the midpoint of the fixing roller 31 regardless of the orientation of the printer 300, the condition of the air convection is the same regardless of the orientation. Therefore, it is possible to use a same correction table.

However, the present embodiment uses the third and fourth correction tables in order to further improve the accuracy of the estimation of the surface temperature, taking the following conditions into account.

That is, although it is the surface temperature of the fixing roller 31 at a point immediately before the fixing nip N that directly affects the fixing quality, the difference in relative position of the temperature sensors 134 and 135 with respect to the fixing nip N leads to the difference of the temperatures actually detected by the first and the second temperature sensors. This is because the time it takes for the portion of the surface at the fixing nip N to reach the detection point of the first temperature sensor 134 is different from the time it takes for the portion to reach the detection point of the second temperature sensor 135, and the temperature of the portion changes more or less according to the elapsed time.

For this reason, correction tables suitable for the horizontal position and the upright position are prepared as the third correction table and the fourth correction table.

Next, when the surface temperature t1 of the fixing roller 31 obtained as described above is lower than the target temperature t0 (Step S37: YES), the CPU 150 turns ON the heater 33 (Step S38) to apply heat to the fixing roller 31. When the surface temperature t1 is equal to or higher than the target temperature t0 (Step S37: NO), the CPU 150 turns OFF the heater 33 (Step S39).

Then, the CPU 150 determines whether to finish the temperature adjustment (Step S40). The CPU 150 determines to finish the temperature adjustment, for example immediately after a print job is completed, or after a predetermined interval from the completion of a print job.

When determining not to finish the temperature adjustment (Step S40: NO), the CPU 150 repeats the above-described Steps S36 through S40.

When determining to finish the temperature adjustment (Step S40: YES), the CPU 150 checks the power state of the heater 33 at the time of the determination. When the heater 33 is ON, the CPU 150 turns OFF the heater 33 (Step S41), and then finishes the temperature adjustment.

As described above, Embodiment 3 is capable of correctly estimating the surface temperature of the fixing roller 31 at a point immediately before the fixing nip N by using the third and fourth correction tables that takes into account the difference in the change amount of temperature due to the difference in the relative position of the first temperature sensor 134 and the second temperature sensor 135 with respect to the fixing nip N.

Furthermore, depending on the orientation of the printer 300, the heat sensitive portion 134*a*, sometimes referred to as the temperature measuring part, of the first temperature sensor 134 or the heat sensitive portion 135*a* of the second temperature sensor 135 is located right above the midpoint of the fixing roller 31, where the mainstream of the ascending air current passes.

With such a structure, Embodiment 3 is capable of more precisely detecting the surface temperature of the fixing roller 31.

Embodiment 4

(4-1) Structure of Image Forming Apparatus

The following describes a printer as an example of an image forming apparatus pertaining to Embodiment 4 of the present invention, with reference to the drawings.

The structure of a printer 400 pertaining to Embodiment 4 is basically similar to the printer 300 pertaining to Embodiment 3 described above, but the printer 400 pertaining to Embodiment 4 is different from the printer 300 in that a single temperature sensor for controlling the temperature of the fixing roller 31 is provided along the outer circumferential surface of the fixing roller 31.

In the following, the same components as Embodiment 1 are given the same reference numbers and their descriptions are omitted or simplified, and mainly the differences will be described.

Figure 10:
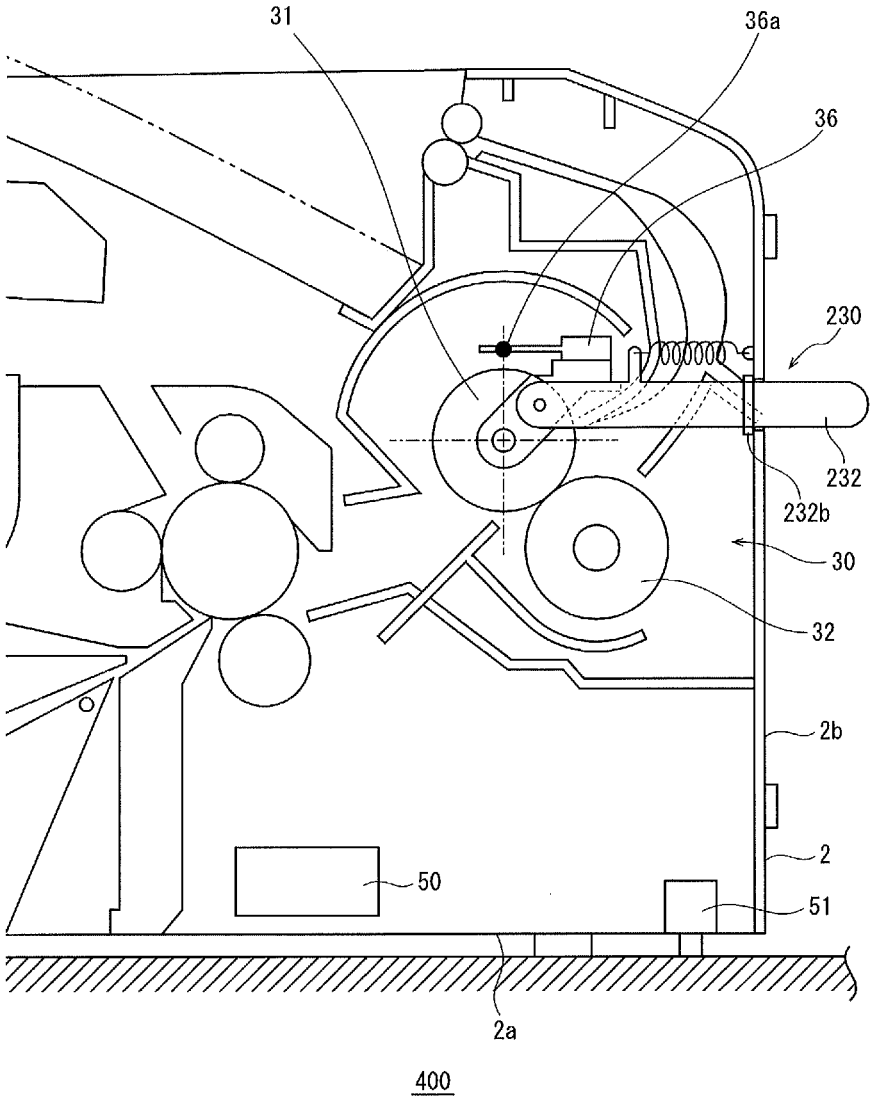
FIG. 10 is a schematic cross-sectional view of an image forming apparatus pertaining to Embodiment 4 of the present invention, orientated in the horizontal position.

FIG. 10 is a schematic cross-sectional view showing primary components included in the fixing unit 30 of the printer 400 pertaining to Embodiment 4 of the present invention. This drawing shows the printer 400 orientated in the horizontal position.

As shown in the drawing, only one temperature sensor 36 is provided as the temperature sensor for adjusting the temperature of the fixing roller 31.

The temperature sensor 36 has a same structure as the temperature sensor 34 of Embodiment 1, and has the heat sensitive portion 36*a*.

Figure 11:
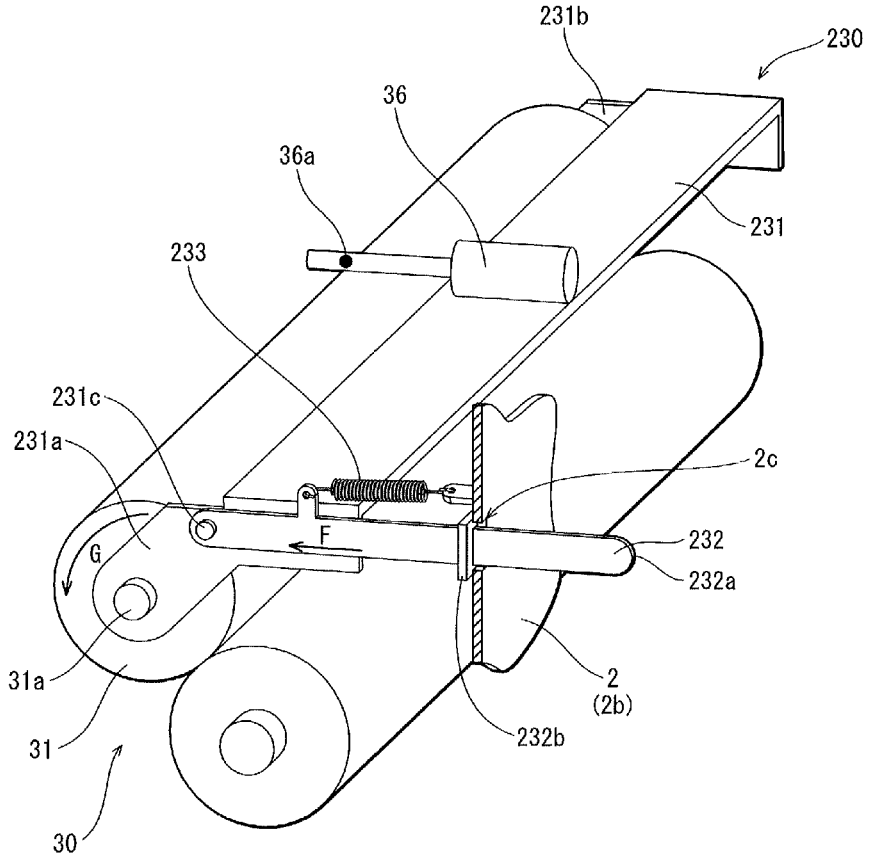
FIG. 11 is a perspective view of a fixing unit and its vicinity of an image forming apparatus pertaining to Embodiment 4.

FIG. 11 is a perspective view illustrating a supporting mechanism 230 of the temperature sensor 36. The supporting mechanism 230, which includes a movement mechanism, is part of a switcher.

As shown in the drawing, the supporting mechanism 230 includes: a supporting member 231 which is arranged in parallel with the fixing roller 31; and side plates 231*a* and 231*b* which are formed by folding both ends of the supporting member 231 by 90°. The side plates 231*a* and 231*b* of the supporting mechanism 230 are attached to a rotational shaft 31*a* of the fixing roller 31 so as to be rotatable about the rotational shaft 31*a*.

The temperature sensor 36 is fixed to the middle area of the supporting member 231 in the longitudinal direction.

Also, a rod 232 is attached to the side plate 231*a* such that an end portion of the rod 232 is rotatable about a pin 231*c* provided at a distance from the rotational shaft 31*a* of the fixing roller 31. The rod 232 and the supporting mechanism 230 constitute a link mechanism.

An end portion 232*a* of the rod 232, which is opposite the end portion supported by the pin 231*c* on the side plate 231*a*, protrudes out of a through hole 2*c* provided in the face 2*b* of the casing 2.

A tension spring 233 is suspended between the rod 232 and the face 2*b* of the casing 2. Hence, the rod 232 is biased by the tension spring 233 to protrude out of the through hole 2*c*.

The rod 232 has a stopper 232*b* like a flange, which is provided in the middle of the rod 232. The stopper 232*h* can be brought into contact with the inner surface of the casing 2. Thus the stopper 232*b* controls the amount of the protrusion of the end portion 232*a* of the rod 232.

When the printer 400 is in the horizontal position, the rod 232 is stopped at the position shown in the drawing. As a result, the heat sensitive portion 36*a* of the temperature sensor 36 fixed to the supporting member 231 comes right above the midpoint of the fixing roller 31 as shown in FIG. 11.

Figure 12:
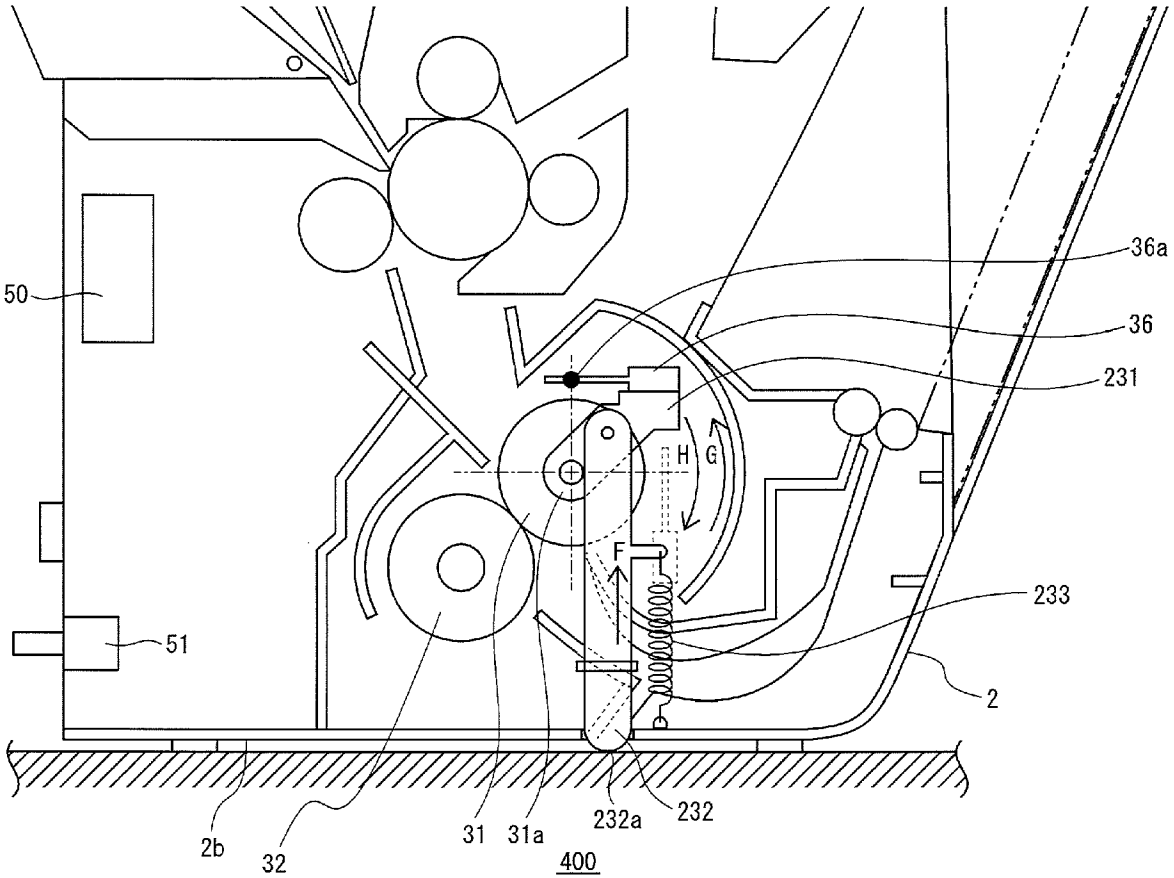
FIG. 12 is a schematic cross-sectional view of the image forming apparatus pertaining to Embodiment 4 of the present invention, orientated in the upright position.

An acquirer acquires orientation information concerning the image forming apparatus. Specifically, when the orientation of the printer 400 is changed from the horizontal position to the upright position as shown in FIG. 12, the face 2*b* of the casing 2 will be the bottom surface, and the end portion 232*a* of the rod 232, sometimes referred to as a movable protruding member, protruding from the face 2*b* is brought into contact with the mounting surface. Thus, the end portion 232*a* is pressed by the mounting surface in the direction indicated by the arrow F, acting against the biasing force of the tension spring 233.

As a result, the supporting member 231 is rotated in the direction indicated by the arrow G, and accordingly the temperature sensor 36 supported by the supporting member 231 moves along the outer circumferential surface of the fixing roller 31.

The sizes and the locations of the above-mentioned parts of the supporting mechanism 230 are designed such that the heat sensitive portion 36*a* of the temperature sensor 36 comes right above the midpoint of the fixing roller 31 when the printer 400 is orientated in the upright position.

As with Embodiment 1, the present embodiment satisfies the condition that the minimum distance between the surface of the fixing roller 31 and the heat sensitive portion 36*a* of the temperature sensor 36 is set to be 2.3 mm±0.3 mm regardless of whether the printer 400 is in the horizontal position or in the upright position.

When the orientation of the printer 400 is changed from the upright position to the horizontal position, the rod 232 protrudes from the casing 2 due to the act of the tension spring 233, since the rod 232 will be released from the pressure by the installation surface which pushes the rod 232 inside the printer 400.

As a result, the supporting member 231 moves backward in the direction indicated by the arrow H, and accordingly the temperature sensor 36 fixed to the supporting member 231 returns to the position indicated by the dotted line.

As described above, the heat sensitive portion 36*a* of the single temperature sensor 36 included in the printer 400 pertaining to Embodiment 4 is moved to the position right above the midpoint of the fixing roller 31 where the mainstream of the ascending air current heated by the fixing roller 31 passes through, according to the orientation of the printer 400. Therefore, unlike the printer 300 pertaining to Embodiment 3, it is unnecessary to provide two temperature sensors, nor to select a temperature sensor.

Note that the processing procedures for the temperature adjustment according to the present embodiment are similar to those represented by the flowchart shown in FIG. 9 related to Embodiment 3. However, the processing of selecting the first or the second temperature sensor 134 and 135 in Steps S34 and S35 is unnecessary.

Like the printer 300 pertaining to Embodiment 3, the present embodiment is capable of more precisely detecting the surface temperature of the fixing roller 31 regardless of the orientation.

Modifications

The present invention is not limited to the embodiments described above. The following modifications may be adopted.

(1) In Embodiment 1 described above, the face 2*a* and the face 2*b* of the casing 2 of the printer 1 are perpendicular to each other. However, the faces 2*a* and 2*b* are not necessarily perpendicular to each other.

Figure 13B:
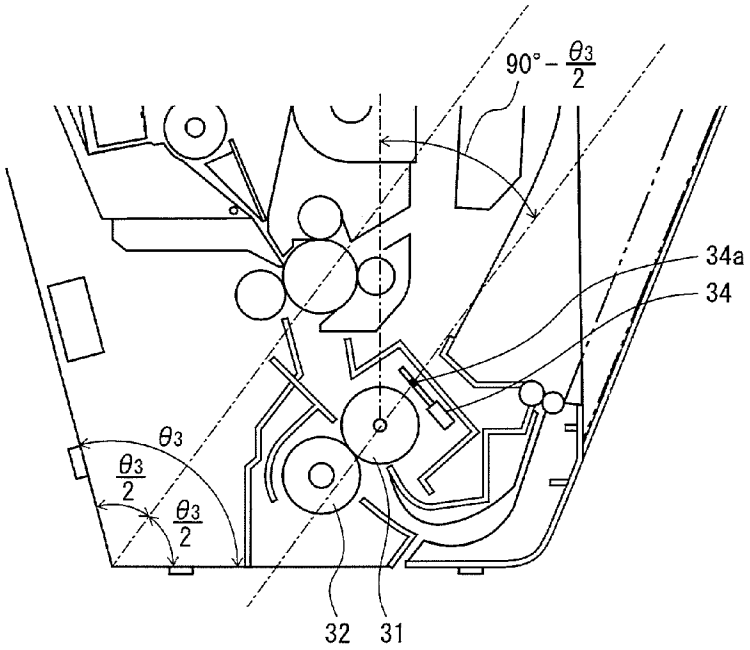
FIG. 13A and FIG. 13B are schematic cross-sectional views of an image forming apparatus pertaining to a modification of the present invention, orientated in the horizontal position and the upright position, respectively.
Figure 13A:
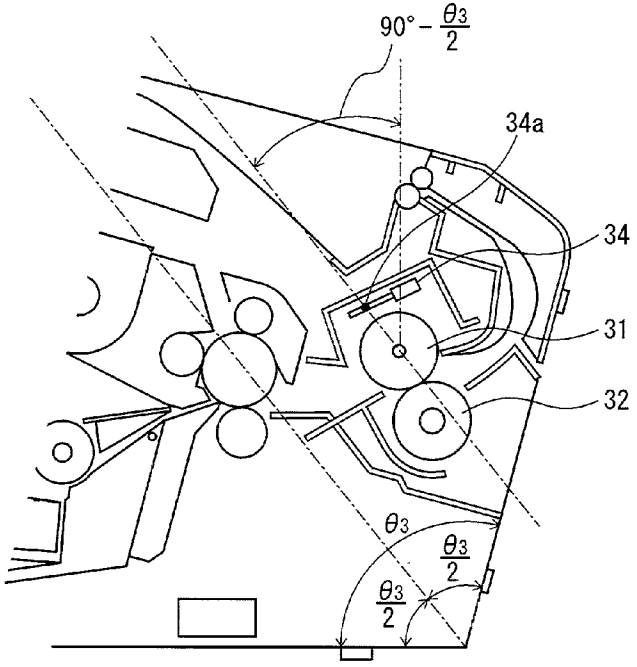

FIGS. 13A and 13B are schematic partial cross-sectional views showing an example having such a structure, orientated in the horizontal position and in the upright position, respectively.

In this example, the face 2*a* and the face 2*b* of the casing 2 are not perpendicular to each other, and instead, form an angle θ3 (degrees) when viewed in the direction along the rotational shaft of the fixing roller 31.

When changing the orientation of the printer 1 from the horizontal position to the upright position by retaining the printer 1, the rotation angle is θ3 (degrees). When the printer 1 is in the horizontal position, the heat sensitive portion 34*a* of the temperature sensor 34 is located on the line tilted counterclockwise by 90-θ3/2 (degrees) from the vertical line passing through the rotational center of the fixing roller 31 as shown in the drawing.

Since the temperature sensor 34 is located as described above, the heat sensitive portion 34*a*, when the printer 1 is in the upright position as shown in FIG. 13B, is located on the line tilted clockwise by 90-θ3/2 (degrees) from the vertical line passing through the rotational center of the fixing roller 31 when seen in the direction of the rotational shaft of the fixing roller 31.

Thus, the location of the heat sensitive portion 34*a* in the case of the horizontal position and the location of the heat sensitive portion 34*a* in the case of the upright position are diametrically opposite each other with respect to the vertical line, and they are under substantially the same condition with respect to the air convection. Therefore, around the heat sensitive portion 34*a*, the state of the heat conduction, including the state of the air convection, is substantially the same regardless of the orientation of the printer 1.

Therefore, the surface temperature of the fixing roller 31 can be precisely estimated with the same correction table regardless of the orientation of the printer 1, and the required size of the correction table storage 155 for storing the correction table can be reduced.

(2) According to Embodiment 4 described above, the heat sensitive portion 36*a* of the temperature sensor 36 is movable and is located right above the midpoint of the fixing roller 31 regardless of whether the printer 400 is in the horizontal position or in the upright position. However, the present invention is not limited such a structure.

For example, even if the heat sensitive portion 36*a* is not located right above the midpoint of the fixing roller 31, it is possible to estimate the surface temperature of the fixing roller 31 by using different correction tables, each corresponding to one of the positions and one of the locations of the heat sensitive portion 36*a*, like the case of Embodiment 2.

For the same reason, the first temperature sensor 134 and the second temperature sensor 135 of Embodiment 3 described above are not necessarily configured such that they are located right above the midpoint of the fixing roller 31 regardless of whether the printer 300 is in the horizontal position or in the upright position.

(3) In the Embodiments described above, the correction table storage 155 stores a correction table for estimating the surface temperature of the fixing roller 31 based on the output from the temperature sensor when the printer is in the horizontal position.

However, the correction table storage 155 may store more rigorous correction tables for improvement in accuracy of the temperature detection by the fixing roller 31.

Strictly saying, the value output by the temperature sensor is under the influence of both the heat conducted from the surface of the fixing roller 31 due to the air convection and the temperature within the housing of the fixing unit 30 (hereinafter referred to as "the atmospheric temperature").

Therefore, the difference between the actual surface temperature of the fixing roller 31 and the detected value of the temperature sensor slightly changes according to the atmospheric temperature around the fixing unit 30 at the beginning of the temperature adjustment.

That is, although the value detected by the temperature sensor correctly reflects the surface temperature of the fixing roller 31 when the atmospheric temperature is low, a high atmospheric temperature has a great influence on the value detected by the temperature sensor, and raises the need to modify the correction coefficient.

Considering this fact, the surface temperature of the fixing roller 31 can be more accurately estimated by: providing a temperature sensor for detecting the atmospheric temperature (hereinafter referred to as "the atmospheric temperature sensor") located away from the fixing roller 31, in addition to the temperature sensor for detecting mainly the surface temperature of the fixing roller 31 (hereinafter referred to as "the temperature sensor for the temperature adjustment") used for the temperature adjustment; preparing a plurality of correction tables each showing correction coefficients for a given atmospheric temperature, and storing the tables in the correction table storage 155. At the temperature adjustment, one of the correction tables is selected according to the detection value of the atmospheric temperature sensor, and the selected correction table is used for correcting the value detected by the temperature sensor for the temperature adjustment.

If various correction tables are prepared for each orientation of the printer, the required size of the storage for storing the correction tables increases. However, as described above, the present invention can use the same correction tables for each orientation of the printer, and thereby reduces the required size of the storage.

(4) In Embodiment 2 described above, the orientation detector 51 is used for obtaining the orientation of the printer 200. However, the present invention is not limited to such a structure.

For example, the orientation of the printer 200 may be specified by the user. For example, the user may input to a receiver an instruction specifying the orientation of the printer 1 from the operation panel (not illustrated) of the printer 1, or operating a manual switch or the like. Alternatively, the orientation of the printer 1 may be detected by using an inclination sensor or an acceleration sensor, instead of the push switch described above. Inclination sensors and acceleration sensors detect the direction of the acceleration due to gravity.

(5) In Embodiments described above, the fixing roller 31 is applied heat by the heater 33 built in the fixing roller 31. However, the present invention is not limited to such a structure.

In recent years, so called loose-fitting fixing devices have been developed. In such a fixing device, no heater is built in the fixing roller. Instead, a roller is loosely inserted in an endless fixing belt including a heating layer having an inside diameter that is slightly larger than the outer diameter of the roller. The heating layer of the fixing belt is inductively heated.

This structure is advantageous in its capability of reducing the warming up time due to a high heat-insulating efficiency, since only part of the outer circumferential surface of the fixing belt is brought into contact with the outer circumferential surface of the roller.

When the loose-fitting fixing device is adopted, the subject of the temperature detection is not the fixing roller, but the fixing belt. As described above, any component that can serve as the heating roller may be the subject of the temperature detection.

(6) In Embodiments described above, the fixing roller and the pressure roller are pressed against each other in order to form the fixing nip N. However, the present invention is not limited to such a structure.

For example, instead of the pressure roller, a pressure pad whose surface is covered with low friction material or the like may be pressed against the fixing roller. That is, any component may be adopted providing that it is slidable on the surface of the fixing roller while applying pressure to the fixing roller.

(7) Embodiments above exemplify the cases where an image forming apparatus pertaining to the present invention is applied to a monochrome printer. However, the present invention may be applied to a tandem color digital printer. That is, the present invention is generally applicable to any image forming apparatus that is orientatable in different positions and provided with a fixing device having a heating roller.

Also, the present invention may be any combinations of the Embodiments and Modifications described above.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus that is orientatable in either a first position or a second position, the second position being different from the first position in inclination with respect to a horizontal plane, comprising:

a fixing device that includes a heating roller and a pressurizing member, presses the pressurizing member against a surface of the heating roller to form a fixing nip, and thermally fixes a toner image formed on a recording sheet passing through the fixing nip;

at least one temperature detector that detects temperature of the surface of the heating roller without contact with the surface;

a heater that heats the heating roller; and a controller that controls the heater according to the temperature detected by the at least one temperature detector, and thereby controls the temperature of the surface of the heating roller, wherein a detection point of the at least one temperature detector is located above a horizontal plane passing through a rotational axis of the heating roller regardless of whether the image forming apparatus is in the first position or in the second position;

the image forming apparatus further comprising a switcher that switches a detection point of the at least one temperature detector between a first detection point and a second detection point according to whether the image forming apparatus is in the first position or in the second position;

wherein the switcher serves as a movement mechanism that moves the at least one temperature detector according to whether the image forming apparatus is in the first position or in the second position.

2. The image forming apparatus of claim 1, wherein the at least one temperature detector has a temperature measuring part, the second position is an orientation rotated from the first position by an angle of θ degrees, and when the image forming apparatus is in the first position, the detection point of the temperature measuring part, viewed in a direction along the rotational axis of the heating roller, is located on a straight line that passes through a rotational center of the heating roller and that is tilted from a vertical line passing through the rotational center by an angle of 90-θ/2 degrees in a direction opposite the rotation from the first position to the second position.

3. The image forming apparatus of claim 2, wherein

θ is 90.

4. The image forming apparatus of claim 1, wherein the switcher includes:

a supporting member that supports and moves the at least one temperature detector; and a movable protruding member that protrudes from a side of a casing of the image forming apparatus when the image forming apparatus is in the first position, and becomes embedded in the casing by being pressed by an installation surface when the image forming apparatus is in the second position, the installation surface being a surface on which the image forming apparatus is installed, and the switcher serves as a link mechanism that converts movement of the protruding member into a force for moving the supporting member and transmits the force to the supporting member, by which the supporting member moves the at least one temperature detector.

5. The image forming apparatus of claim 4 further comprising:

a storage that stores a first correction table corresponding to the first position and a second correction table corresponding to the second position; and an acquirer that acquires orientation information indicating whether the image forming apparatus is in the first position or in the second position, wherein the controller selects either the first correction table or the second correction table whichever corresponds to the orientation information acquired by the acquirer, and controls the temperature of the surface of the heating roller by using either the first correction table or the second correction table whichever is selected by the controller and the temperature detected by the at least one temperature detector.

6. The image forming apparatus of claim 1 further comprising:

a storage that stores a common correction table that is used regardless of whether the image forming apparatus is in the first position or in the second position, wherein the controller estimates the temperature of the surface of the heating roller by using the common correction table and the temperature detected by the at least one temperature detector.

7. The image forming apparatus of claim 1 further comprising:

a storage that stores a first correction table corresponding to the first position and a second correction table corresponding to the second position; and an acquirer that acquires orientation information indicating whether the image forming apparatus is in the first position or in the second position, wherein the controller selects either the first correction table or the second correction table whichever corresponds to the orientation information acquired by the acquirer, and controls the temperature of the surface of the heating roller by using either the first correction table or the second correction table whichever is selected by the controller and the temperature detected by the at least one temperature detector.

8. The image forming apparatus of claim 7 further comprising:

a receiver that receives the orientation information from a user, wherein the acquirer acquires the orientation information via the receiver.

9. The image forming apparatus of claim 7 further comprising:

an orientation detector that detects orientation of the image forming apparatus, wherein the acquirer acquires the orientation information by receiving information about the orientation from the orientation detector.

10. An image forming apparatus that is orientatable in either a first position or a second position, the second position being different from the first position in inclination with respect to a horizontal plane, comprising:

a fixing device that includes a heating roller and a pressurizing member, presses the pressurizing member against a surface of the heating roller to form a fixing nip, and thermally fixes a toner image formed on a recording sheet passing through the fixing nip;

at least one temperature detector that detects temperature of the surface of the heating roller without contact with the surface;

a heater that heats the heating roller;

a controller that controls the heater according to the temperature detected by the at least one temperature detector, and thereby controls the temperature of the surface of the heating roller;

a switcher that switches a detection point of the at least one temperature detector between a first detection point and a second detection point according to whether the image forming apparatus is in the first position or in the second position;

a storage that stores a first correction table corresponding to the first position and a second correction table corresponding to the second position, the first correction table based on a positional relationship between the fixing nip and the detection point of the at least one temperature detector when the image forming apparatus is in the first position, the second correction table based on a positional relationship between the fixing nip and the detection point of the at least one temperature detector when the image forming apparatus is in the second position; and an acquirer that acquires orientation information indicating whether the image forming apparatus is in the first position or in the second position, wherein the detection point of the at least one temperature detector is located vertically above a rotational center of the heating roller regardless of whether the image forming apparatus is in the first position or in the second position, and the controller estimates the temperature of the surface of the heating roller by using the temperature detected by the at least one temperature detector and one of the first correction table and the second correction table that corresponds to a current position of the image forming apparatus.

11. The image forming apparatus of claim 10, wherein the at least one temperature detector has a temperature measuring part, the second position is an orientation rotated from the first position by an angle of θ degrees, and when the image forming apparatus is in the first position, the detection point of the temperature measuring part, viewed in a direction along the rotational axis of the heating roller, is located on a straight line that passes through a rotational center of the heating roller and that is tilted from a vertical line passing through the rotational center by an angle of 90-θ/2 degrees in a direction opposite the rotation from the first position to the second position.

12. The image forming apparatus of claim 11, wherein

θ is 90.

13. The image forming apparatus of claim 10, wherein the switcher serves as a movement mechanism that moves the at least one temperature detector according to whether the image forming apparatus is in the first position or in the second position.

14. The image forming apparatus of claim 10, further comprising:

the switcher switches the detection point so that regardless of whether the image forming apparatus is in the first position or the second position, a detection error in temperature detection by the at least one temperature detector does not exceed a predetermined range.

15. The image forming apparatus of claim 10, wherein the at least one temperature detector includes a first temperature sensor that is located at the first detection point when the image forming apparatus is in the first position and a second temperature sensor that is located at the second detection point when the image forming apparatus is in the second position, the first and second temperature sensors being non-contact type sensors, and the switcher switches the detection point by selecting either the first temperature sensor or the second temperature sensor, which respectively correspond to the first detection point and the second detection point, according to the orientation information acquired by the acquirer.

16. The image forming apparatus of claim 10, wherein the switcher includes:

a supporting member that supports and moves the at least one temperature detector; and a movable protruding member that protrudes from a side of a casing of the image forming apparatus when the image forming apparatus is in the first position, and becomes embedded in the casing by being pressed by an installation surface when the image forming apparatus is in the second position, the installation surface being a surface on which the image forming apparatus is installed, and the switcher serves as a link mechanism that converts movement of the protruding member into a force for moving the supporting member and transmits the force to the supporting member, by which the supporting member moves the at least one temperature detector.

17. The image forming apparatus of claim 10, further comprising:

a storage that stores a common correction table that is used regardless of whether the image forming apparatus is in the first position or in the second position, wherein the controller estimates the temperature of the surface of the heating roller by using the common correction table and the temperature detected by the at least one temperature detector.

18. The image forming apparatus of claim 10, wherein the controller selects either the first correction table or the second correction table whichever corresponds to the orientation information acquired by the acquirer, and controls the temperature of the surface of the heating roller by using either the first correction table or the second correction table whichever is selected by the controller and the temperature detected by the at least one temperature detector.

* * * * *